US009423125B2

(12) United States Patent
Carroni et al.

(10) Patent No.: US 9,423,125 B2
(45) Date of Patent: Aug. 23, 2016

(54) BURNER WITH LANCE

(75) Inventors: Richard Carroni, Niederrohrdorf (CH); Madhavan Narasimhan Poyyapakkam, Mellingen (CH); Michal Bialkowski, Untersiggenthal (CH); Mark Andrew Willetts, Leicestershire (GB)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 1107 days.

(21) Appl. No.: 12/437,223

(22) Filed: May 7, 2009

(65) Prior Publication Data

US 2009/0280443 A1 Nov. 12, 2009

(30) Foreign Application Priority Data

May 9, 2008 (EP) ..... 08103889

(51) Int. Cl.

| | |
|---|---|
| ***F23C 5/00*** | (2006.01) |
| ***F02C 1/00*** | (2006.01) |
| ***F02C 7/22*** | (2006.01) |
| ***F23D 14/64*** | (2006.01) |
| ***F23D 11/10*** | (2006.01) |
| ***F23D 17/00*** | (2006.01) |
| ***F23D 3/20*** | (2006.01) |
| ***F23R 3/28*** | (2006.01) |

(52) U.S. Cl.

CPC *F23D 14/64* (2013.01); *F23D 3/20* (2013.01); *F23D 11/101* (2013.01); *F23D 17/002* (2013.01); *F23R 3/286* (2013.01); *F23D 2900/11001* (2013.01)

(58) Field of Classification Search

CPC ..... F23D 11/101; F23D 17/002; F23D 14/64; F23R 3/20; F23R 3/286

USPC ..... 431/8; 60/742, 776

See application file for complete search history.

(56) References Cited

U.S. PATENT DOCUMENTS

| | | | | |
|---|---|---|---|---|
| 5,016,443 | A * | 5/1991 | Shimizu | F23R 3/286 60/39.23 |
| 5,487,659 | A * | 1/1996 | Eroglu et al. | 431/350 |
| 5,497,611 | A * | 3/1996 | Benz | F23R 3/02 60/776 |
| 5,593,302 | A * | 1/1997 | Althaus et al. | 431/353 |
| 6,688,111 | B2 * | 2/2004 | Stalder et al. | 60/776 |
| 2008/0041060 | A1 * | 2/2008 | Nilsson et al. | 60/737 |

FOREIGN PATENT DOCUMENTS

| | | |
|---|---|---|
| EP | 0769657 A2 | 4/1997 |
| EP | 1890083 A1 | 2/2008 |

* cited by examiner

*Primary Examiner* — William G Corboy

(74) *Attorney, Agent, or Firm* — Buchanan Ingersoll & Rooney PC

(57) ABSTRACT

The present invention relates to a burner for a combustion chamber of a gas turbine plant. The burner includes a lance for introducing gaseous fuel into the burner. A shaft of the lance has at least one nozzle for introducing gaseous fuel into the burner. A main injection direction of the respective nozzle is oriented onto a portion of a burner wall. An introduction device for a diverting fluid is provided, which is designed for introducing a diverting fluid counteracting an impingement of the fuel flow on the burner wall.

12 Claims, 2 Drawing Sheets

BURNER WITH LANCE

FIELD OF THE INVENTION

The present invention relates to a burner for a second combustion chamber of a gas turbine plant with sequential combustion having a first and a second combustion chamber, said burner being equipped with a lance.

BACKGROUND OF THE INVENTION

Conventional burners as for example known from the DE10128063 may be equipped with a lance for introducing gaseous and/or liquid fuels into the burner. The introduction of fuel via the lance may be utilized, for example, for pilot operation or for stabilizing a combustion reaction in the combustion space of a combustion chamber. Usually, a shaft of such a lance has at least one nozzle for introducing fuel into the burner. An example for such a fuel lance is given in the DE4326802.

Conventional burners preferably operate with natural gas as gaseous fuel. In this case, it is customary to provide the lance shaft along its circumference with a plurality of nozzles, through which the fuel gas can flow out essentially radially with respect to a longitudinal mid-axis of the shaft. A main injection direction of the respective nozzle is thereby oriented essentially radially onto a burner wall. In conjunction with an oxidizer gas flow present in the burner during operation, the fuel gas emerging radially from the lance is entrained in the main flow direction of the oxidizer gas, thus resulting in the desired intermixing between the oxidizer gas and fuel gas.

In modern combustion chambers, other gaseous fuels may also be used, which are distinguished by increased reactivity, as compared with a natural gas. These are, for example, fuel gases which contain hydrogen gas and, moreover, may contain carbon monoxide gas. Such a fuel gas containing hydrogen gas and carbon monoxide gas can be generated, for example, by means of the partial oxidation of long-chain hydrocarbons. A fuel gas of this type may also be designated as synthesis gas or syngas. If, then, a synthesis gas of this type is used as fuel gas in a conventional burner, this may lead to difficulties, since conventional burners are not suitable per se for use with fuel gases having such high reactivity. For example, reactive fuel gases of this type ignite even at lower temperatures and therefore with markedly shorter dwell times in the burner. In order in this case to avoid a hazardous flashback, for example, the mass flow of fuel gas can be increased correspondingly. Further, these gases have a lower calorific value than natural gas. Thus, higher mass and volume flows are needed, resulting in changed fuel distribution when fuel is injected from conventional natural gas holes. With an increased fuel mass flow, however, an undesirable enrichment of fuel gas in the region of the burner wall may occur, with the result that an intensive intermixing with the oxidizer gas, which is preferably air, takes place only inadequately. Inadequate intermixing, however, may lead to increased combustion temperatures, thus ultimately entailing increased pollutant values. Further, if fuel is concentrated near the wall, a flame can stabilize in the wall region due to low flow velocities in the wall, which can quickly lead to severe damages on the hardware.

SUMMARY OF THE INVENTION

The invention is concerned with the problem of specifying for a burner of the type initially mentioned an improved embodiment which is distinguished, in particular, in that, with it, a relatively good intermixing of the introduced fuel gas with the oxidizer gas is achieved and/or consequently reduced pollutant emissions are implemented, while, moreover, the burner is to be capable of being operated with a fuel gas containing hydrogen gas.

The invention is based on the general idea of equipping the burner in the region of its burner wall with an introduction device for a diverting fluid, which introduction device can introduce, in each case in a wall portion onto which a main injection direction of a nozzle of the lance is oriented, a diverting fluid which redirects the fuel flow before it impinges onto the burner wall. As a result of this design, the fuel gas introduced into the burner by the lance-side nozzle flows counter to a directionally oriented diverting fluid, with the result that the fuel gas flow can be stagnated and, in conjunction with the oxidizer gas flow prevailing in the burner, can be deflected to an increased extent in its main flow direction. A concentration of the fuel gas in regions of the burner wall can thereby be avoided or at least reduced. Overall, therefore, an improved homogenization of the fuel gas and oxidizer gas can be achieved by means of the proposed measure. This leads to improved emission values, even when a fuel gas containing hydrogen gas is used. Different gases can be used as diverting fluid. For example oxidizer gas, which is typically air, can be used as diverting fluid. Steam or inert gases are also suitable as diverting fluids. Further, depending on its reactivity and the flow field, fuel gas can also be used as diverting fluid. A combination of the different gas types or the use of fine water spay is also conceivable.

An embodiment is particularly advantageous in which the introduction device has in the burner wall, for each shaft nozzle oriented onto the burner wall, itself a directionally oppositely directed nozzle for introducing the diverting fluid. As a result, in particular, an individual adaptation of the individual nozzle pairings to one another can be implemented. This is advantageous particularly when the flow conditions within the burner vary in the circumferential direction. This is the case, for example, when the shaft is positioned in the burner via a base angled at right angles to said shaft. Different flow conditions necessarily exist in the wake of the base from those outside the wake.

In case of dual fuel applications, i.e. burners, which are capable of burning gaseous and liquid fuels additional injection means for injection of the liquid fuel have to be provided. Typically these means are nozzles for the injection of liquid fuel, which are arranged in the lance and for example inject fuel in the main flow direction from the downstream end of the shaft, as known for example from the DE4326802.

Further important features and advantages of the present invention may be gathered from the subclaims, from the drawing and from the accompanying figure description with reference to the drawing.

BRIEF DESCRIPTION OF THE DRAWINGS

Some preferred exemplary embodiments of the invention are illustrated in the drawing and are explained in more detail in the following description.

DETAILED DESCRIPTION OF THE INVENTION

Figure 1:
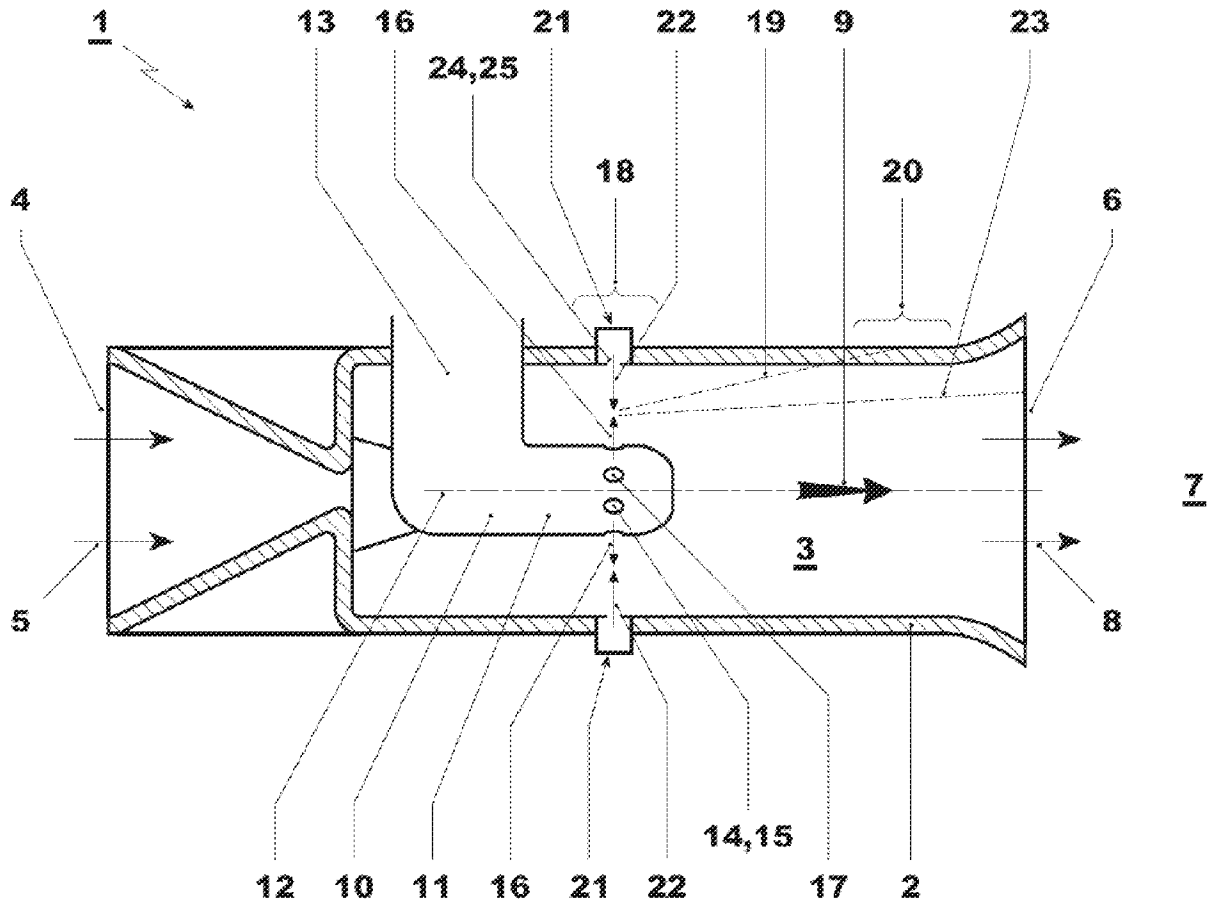
FIG. 1 shows a greatly simplified longitudinal section through a burner with a lance.
Figure 2:
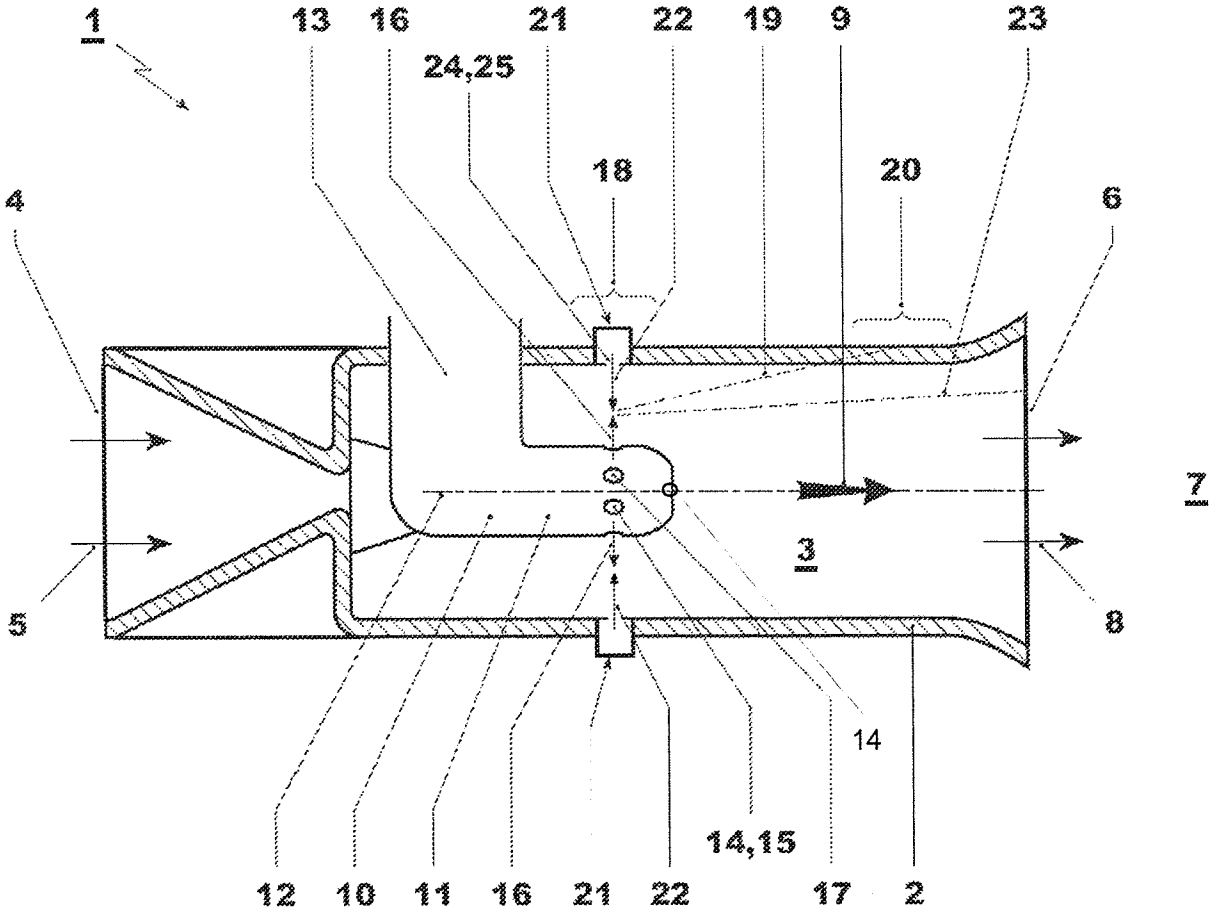
FIG. 2 shows a longitudinal section through a burner with a lance having a nozzle for introduction of liquid fuel in the main flow direction and arranged at the downstream end of the shaft.

According to FIG. 1, a burner 1 has a burner wall 2 which laterally delimits a mixing space 3 of the burner 1. The burner 1 usually forms an integral part of a combustion chamber, otherwise not illustrated here, of a gas turbine plant. The burner 1 has an inlet side 4 through which an oxidizer gas, preferably air, enters the mixing space 3. A corresponding oxidizer gas flow is indicated by arrows 5. Furthermore, the burner 1 has an outlet side 6 through which gas flows out of the mixing space 3 and, in particular, enters a combustion space 7 of the combustion chamber. A corresponding gas flow is indicated by arrows 8. The throughflow of the burner 1 or of the mixing space 3 mainly takes place in a longitudinal direction of the burner 1, with the result that a main throughflow direction or main flow direction 9 of the burner is defined, which is indicated in FIG. 1 by an arrow.

The burner 1, moreover, has a lance 10, with the aid of which a gaseous fuel can be introduced into the burner 1 or into the mixing space 3. The lance 10 has a shaft 11 which preferably has a cylindrical body and possesses a longitudinal mid-axis 12. The lance 10 is expediently arranged in the burner 1 such that the shaft 11 is oriented with its longitudinal mid-axis 12 parallel to the main flow direction 9 prevailing in the burner 1. In the example shown, moreover, the lance 10 has a base 13, from which the shaft 11 is angled at 90°. The base 13 extends transversely with respect to the main flow direction 9 of the burner 1 and is fastened to the burner wall 2 in a suitable way. The base 13 thus positions the shaft 11 in the burner 1.

The lance shaft 11 is equipped with at least one nozzle 14, with the aid of which gaseous fuel can be introduced into the burner 1 or into the mixing space 3. In the example, the shaft 11 possesses a plurality of such nozzles 14 which are arranged in the circumferential direction of the shaft 11 along a row 15 which extends annularly and coaxially with respect to the longitudinal mid-axis 12 of the shaft 11. Within the row 15, the individual nozzles 14 are arranged adjacently, spaced apart from one another.

The respective nozzle 14 is configured such that it injects the fuel gas into the burner 1 in a main injection direction 16. The respective nozzle 14 usually generates a conical spray jet which emerges from a corresponding outlet orifice 17 of the respective nozzle 14. The longitudinal mid-axis of the respective conical body then forms the main injection direction 16 of the respective nozzle 14. In the example shown, purely by way of example, two arrows are depicted which symbolize the main injection directions 16 of two nozzles 14 lying diametrically opposite one another. It is notable, here, that the nozzles 14 are configured such that the main injection directions 16 are oriented radially with respect to the main flow direction 9 or with respect to the longitudinal mid-axis 12.

In any event, the nozzles 14 are configured such and/or arranged on the shaft 14 such that the associated main injection direction 16 is oriented onto a portion 18, identified here by a curly bracket, of the burner wall 2. This means that the respective fuel jet would impinge upon the burner wall 2 in said portion 18 in the absence of an oxidizer gas flow 5. In the presence of an oxidizer gas flow 5, a pronounced deflection of the fuel gas in the direction of the oxidizer gas flow occurs. The resulting direction in which part of the fuel gas could reach the burner wall is indicated by a straight line designated 19. If this dotted line 19 is followed, this gives rise on the burner wall 2 to a region 20, symbolized by a curly bracket, in which, in the presence of an oxidizer flow 5, the fuel gas could impinge onto the burner wall 2 if an increased inflow velocity is set for the fuel gas. An increased flow velocity of this kind is required, for example, when an increased volume flow is to be implemented for the reliable use of a fuel gas containing hydrogen gas. The contacting of fuel gas with the burner wall 2 could lead in the region 20 to an enrichment of fuel gas, and this may lead subsequently in the combustion space 7 or even in the mixing space 3 to an unfavorable combustion reaction with increased pollutant values. In worst case this can even result in a flash back.

The burner 1, moreover is equipped with an introduction device 21, with the aid of which a diverting fluid, which may be, for example, oxidizer gas, that is to say preferably air, can be introduced into the burner 1 or into the mixing space 3 through the burner wall 2. While fuel gas can thus be introduced into the mixing space 3 virtually from inside by means of the lance 10, the introduction device 21 makes it possible to introduce diverting fluid into the mixing space 3 virtually from outside. The introduction device 21, then, allows a directed introduction of diverting fluid in said wall portion 18 in such a way as thereby to give rise, according to arrows 22, to a diverting fluid flow which redirects the fuel flow and counteracts an impingement of the fuel flow 16 on the burner wall 2. This results, for example, in a deflection of the fuel flow leads past the burner wall 2 as indicated by the dotted straight line 23, with the result that contacting between the fuel gas and burner wall 2 can be avoided effectively.

The introduction device 21 for the diverting fluid expediently generates a main introduction direction which is likewise represented here by the arrows 22 and is likewise designated below by 22. The embodiment shown here is particularly advantageous, in which the introduction device 21 is configured such that the main introduction direction 22 consequently generated coincides with the main injection direction 16 of the respective nozzle 14 and is directed opposite to this. In the best case, a compensation of the flows can be achieved, so that the deflection of the fuel flow leads to the straight line 23 running essentially parallel to the main flow direction 9.

An embodiment is particularly advantageous in which the introduction device 21 has at least one nozzle 24, with the aid of which the diverting fluid can be introduced into the mixing space 3 and which, in particular, can generate the abovementioned main introduction direction 22 for the diverting fluid flow. The respective nozzle 24 of the introduction device 21 is preferably arranged opposite the respective nozzle 14 of the shaft 11 on or in the burner 1.

An embodiment is particularly advantageous in which for each nozzle 14 arranged on the shaft 11 a nozzle 24 is arranged on the burner wall 2. It is further possible to assign to each nozzle 14 arranged on the shaft one nozzle 24 arranged on the burner wall 2, which is aligned with it. In the example shown, therefore, a plurality of nozzles 24 are arranged, distributed in the circumferential direction of the burner 1, along the burner wall 2. These burner wall-side nozzles 24 are preferably arranged next to one another along an annular row 25 which extends coaxially with respect to the main flow direction 9 or coaxially with respect to the longitudinal mid-axis 12 of the shaft 11.

In the case of shaft-side nozzles 14 which generate a radial main injection direction 16, the burner wall-side nozzles 24 are expediently configured such that they generate a main introduction direction 22 oriented radially with respect to the main flow direction 9 or radially with respect to the longitudinal mid-axis 12 of the shaft 11.

It is clear that the shaft 11 may basically also have a plurality of rows 15 of nozzles 14. The introduction device 21, too, may likewise have a plurality of rows 25 of nozzles 24. Alternatively, the introduction device 21 may have, instead of singular nozzles 24, large-area introduction zones for generating a more or less directed diverting fluid flow. In particular, the introduction of diverting fluid then does not have to be limited to the wall portion 18, but can be extended to downstream wall portions or shifted into these.

Instead of the plurality of nozzles 14, in another embodiment, at least one single slit-shaped opening extending circumferentially around the shaft 11 is used for introduction of the fuel. Complementarily to this, the introduction device 21 may also have at least one corresponding slit-shaped opening extending in circumferential direction around the burner wall 2 for introducing the diverting fluid.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A burner for a second combustion chamber of a gas turbine plant with sequential combustion having a first combustion chamber and the second combustion chamber, wherein the second combustion chamber has a combustion space downstream of the burner, the burner comprising:

a burner wall;

an introduction device provided on the burner wall laterally delimiting a mixing space of the burner and extending the mixing space downstream;

a lance in the mixing space for introducing gaseous fuel into the burner, the lance comprising a shaft having a longitudinal mid-axis extending parallel to a main flow direction and at least one nozzle for introducing gaseous fuel into the burner with a main injection direction towards the burner wall, wherein the lance has a base, which extends transversely with respect to the main flow direction and is fastened to the burner wall;

an outlet side of the burner through which gas flows out of the mixing space and enters the combustion space of the second combustion chamber;

wherein the introduction device introduces a diverting fluid consisting of an oxidizer gas, air, steam or an inert gas into the burner and directs the diverting fluid towards the longitudinal mid-axis of the shaft to divert the gaseous fuel injected by the at least one nozzle and counteracting an impingement of the fuel flow onto the burner wall; and wherein the introduction device introduces the diverting fluid into the burner with a main introduction direction which is parallel and opposite to the main injection direction of the respective nozzle, wherein the introduction device comprises at least one nozzle for introducing the diverting fluid, which is arranged radially opposite to the respective nozzle of the shaft, wherein for each nozzle arranged on the shaft, one nozzle of the introduction device is arranged either in or on the burner wall.

2. The burner of claim 1, wherein the main injection direction is radially outwards with respect to the longitudinal mid-axis.

3. The burner of claims 1, wherein a main introduction direction with which the introduction device introduces the diverting fluid into the burner is towards the longitudinal mid-axis.

4. The burner of claim 1, wherein a plurality of nozzles of the lance are arranged next to one another on the shaft along an annular row.

5. The burner of claim 1, wherein a plurality of nozzles of the lance are arranged next to one another distributed in the circumferential direction of the shaft.

6. The burner of claim 1, wherein the lance has a base which extends perpendicularly or at an inclination to the main flow direction in the burner and from which the shaft emanates and extends parallel to the main flow direction.

7. The burner of claim 1, further including at least one nozzle for introduction of liquid fuel in the main flow direction and arranged at the downstream end of the shaft.

8. A burner for a second combustion chamber of a gas turbine plant with sequential combustion having a first combustion chamber and the second combustion chamber, wherein the second combustion chamber has a combustion space downstream of the burner, the burner comprising:

a burner wall;

an introduction device provided on the burner wall laterally delimiting a mixing space of the burner and extending the mixing space downstream;

a lance in the mixing space for introducing gaseous fuel into the burner, the lance comprising a shaft having a longitudinal mid-axis extending parallel to a main flow direction and at least one nozzle for introducing gaseous fuel into the burner with a main injection direction towards the burner wall, and wherein the lance has a base, which extends transversely with respect to the main flow direction and is fastened to the burner wall;

an outlet side of the burner through which gas flows out of the mixing space and enters the combustion space of the second combustion chamber;

wherein the introduction device introduces a diverting fluid into the burner and directs the diverting fluid consisting of an oxidizer gas, air, steam or an inert gas towards the longitudinal mid-axis of the shaft to divert the gaseous fuel injected by the at least one nozzle and counteracting an impingement of the fuel flow onto the burner wall;

wherein the base of the lance extends perpendicularly or at an inclination to the main flow direction in the burner and from which the shaft emanates and extends parallel to the main flow direction; and wherein the introduction device introduces the diverting fluid into the burner with a main introduction direction which is parallel and opposite to the main injection direction of the respective nozzle, wherein the introduction device comprises at least one nozzle for introducing the diverting fluid, which is arranged radially opposite to the respective nozzle of the shaft, wherein for each nozzle arranged on the shaft, one nozzle of the introduction device is arranged either in or on the burner wall.

9. The burner of claim 8, wherein the main injection direction is radially outwards with respect to the longitudinal mid-axis.

10. The burner of claims 8, wherein a main introduction direction with which the introduction device introduces the diverting fluid into the burner is towards the longitudinal mid-axis.

11. The burner of claim 8, comprising:

a plurality of nozzles of the lance, and wherein the plurality of the nozzles are arranged next to one another on the shaft along an annular row.

12. The burner of claim 8, wherein the plurality of nozzles are arranged next to one another distributed in the circumferential direction of the shaft.

* * * * *